US008397823B2

(12) United States Patent
Xu

(10) Patent No.: US 8,397,823 B2
(45) Date of Patent: Mar. 19, 2013

(54) TUBULAR ACTUATOR, SYSTEM AND METHOD

(75) Inventor: Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 275 days.

(21) Appl. No.: 12/538,587

(22) Filed: Aug. 10, 2009

(65) Prior Publication Data

US 2011/0030968 A1 Feb. 10, 2011

(51) Int. Cl.
*E21B 34/06* (2006.01)

(52) U.S. Cl. ..... 166/373; 166/386; 166/318; 166/332.8

(58) Field of Classification Search ..... 166/373, 166/386, 194, 177.4, 318, 332.8
See application file for complete search history.

(56) References Cited

U.S. PATENT DOCUMENTS

| | | | | |
|---|---|---|---|---|
| 1,883,071 | A | | 12/1928 | Stone |
| 2,769,454 | A | | 11/1956 | Bletcher et al. |
| 2,812,717 | A | | 11/1957 | Brown |
| 2,822,757 | A | | 2/1958 | Colberly |
| 2,973,006 | A | | 2/1961 | Nelson |
| 3,007,527 | A | | 11/1961 | Nelson |
| 3,013,612 | A | | 12/1961 | Angel |
| 3,148,731 | A | * | 9/1964 | Holden ..... 166/141 |
| 3,211,232 | A | | 10/1965 | Grimmer |
| 3,263,752 | A | | 8/1966 | Conrad |
| 3,358,771 | A | | 12/1967 | Berryman |
| 3,510,103 | A | | 5/1970 | Carsello |
| 3,566,964 | A | | 3/1971 | Livingston |
| 3,667,505 | A | | 6/1972 | Radig |
| 3,703,104 | A | | 11/1972 | Tamplen |
| 3,727,635 | A | | 4/1973 | Todd |
| 3,797,255 | A | | 3/1974 | Kammerer, Jr. et al. |
| 3,901,315 | A | | 8/1975 | Parker et al. |
| 3,954,138 | A | | 5/1976 | Miffre |
| 3,997,003 | A | | 12/1976 | Adkins |
| 4,067,358 | A | | 1/1978 | Streich |

(Continued)

FOREIGN PATENT DOCUMENTS

| | | |
|---|---|---|
| EP | 0427422 A2 | 5/1991 |
| GB | 2281924 | 3/1995 |

(Continued)

OTHER PUBLICATIONS

Response to Office Action dated Oct. 15, 2008, in U.S. Appl. No. 11/891,713, U.S. Patent and Trademark Office, U.S.A.

(Continued)

*Primary Examiner* — David Andrews
(74) *Attorney, Agent, or Firm* — Cantor Colburn LLP

(57) ABSTRACT

A tubular actuating system includes, a tubular, a plurality of same plugs runnable within the tubular, and an alterable actuator disposed at the tubular. The actuator is alterable in response to passage of a first of the plurality of same plugs run into contact therewith. A second of the plurality of same plugs is seatingly engagable with the alterable actuator run there-against when in an altered condition such that pressure built up against the second of the plurality of same plugs causes actuational movement of the alterable actuator. A flapper seat is movably disposed at the alterable actuator between at least a first position defined by the alterable actuator in an unaltered position and a second position defined by the alterable actuator in an altered position.

16 Claims, 9 Drawing Sheets

U.S. PATENT DOCUMENTS 4,160,478 A 7/1979 Calhoun et al.
4,176,717 A 12/1979 Hix
4,190,239 A 2/1980 Schwankhart
4,246,968 A 1/1981 Jessup et al.
4,260,017 A 4/1981 Nelson et al.
4,291,722 A 9/1981 Churchman
4,292,988 A 10/1981 Montgomery
4,355,685 A 10/1982 Beck
4,390,065 A 6/1983 Richardson
4,448,216 A 5/1984 Speegle et al.
4,474,241 A 10/1984 Freeman
4,478,279 A 10/1984 Puntar et al.
4,537,383 A 8/1985 Fredd
4,554,981 A 11/1985 Davies
4,566,541 A 1/1986 Moussy et al.
4,576,234 A 3/1986 Upchurch
4,583,593 A 4/1986 Zunkel et al.
4,669,538 A 6/1987 Szarka
4,711,326 A 12/1987 Baugh et al.
4,714,116 A 12/1987 Brunner
4,729,432 A 3/1988 Helms
4,823,882 A 4/1989 Stokley et al.
4,826,135 A 5/1989 Mielke
1,856,591 A 8/1989 Donovan et al.
4,856,591 A 8/1989 Donovan et al.
4,893,678 A 1/1990 Stokley et al.
4,944,379 A 7/1990 Haaser
4,979,561 A 12/1990 Szarka
5,029,643 A 7/1991 Winslow et al.
5,056,599 A 10/1991 Comeaux et al.
5,230,390 A 7/1993 Zastresek et al.
5,244,044 A 9/1993 Henderson
5,297,580 A 3/1994 Thurman
5,305,837 A 4/1994 Johns et al.
5,335,727 A 8/1994 Cornette et al.
5,343,946 A 9/1994 Morrill
5,529,126 A 6/1996 Edwards
5,609,178 A 3/1997 Hennig et al.
5,704,393 A 1/1998 Connell et al.
5,762,142 A 6/1998 Connell et al.
5,775,421 A 7/1998 Duhon et al.
5,775,428 A 7/1998 Davis et al.
5,813,483 A 9/1998 Latham et al.
5,960,881 A 10/1999 Allamon et al.
6,050,340 A 4/2000 Scott
6,053,250 A 4/2000 Echols
6,079,496 A 6/2000 Hirth
6,102,060 A 8/2000 Howlett et al.
6,155,350 A 12/2000 Melenyzer
6,173,795 B1 1/2001 McGarian et al.
6,220,350 B1 4/2001 Brothers et al.
6,227,298 B1 5/2001 Patel
6,253,861 B1 7/2001 Carmichael et al.
6,293,517 B1 9/2001 Cunningham
6,378,609 B1 4/2002 Oneal et al.
6,474,412 B2 11/2002 Hamilton et al.
6,530,574 B1 3/2003 Bailey et al.
6,547,007 B2 * 4/2003 Szarka et al. ..... 166/317
6,634,428 B2 10/2003 Krauss et al.
6,644,412 B2 11/2003 Bode et al.
6,666,273 B2 12/2003 Laurel
6,668,933 B2 12/2003 Kent
6,681,860 B1 1/2004 Yokley et al.
6,712,145 B2 3/2004 Allamon
6,712,415 B1 3/2004 Darbishire et al.
6,834,726 B2 12/2004 Giroux et al.
6,866,100 B2 3/2005 Gudmestad et al.
6,896,049 B2 5/2005 Moyes
6,948,561 B2 9/2005 Myron et al.
6,983,795 B2 1/2006 Zuklic et al.
7,150,326 B2 12/2006 Bishop et al.
7,322,408 B2 1/2008 Howlett
7,325,617 B2 2/2008 Murray
7,337,847 B2 3/2008 McGarian et al.
7,350,578 B2 4/2008 Szarka et al.
7,377,321 B2 * 5/2008 Rytlewski ..... 166/313
7,387,165 B2 6/2008 Lopez de Cardenas et al.
7,416,029 B2 8/2008 Telfer et al.
7,467,664 B2 12/2008 Cochran et al.
7,503,390 B2 3/2009 Gomez
7,503,392 B2 3/2009 King et al.
7,520,336 B2 4/2009 Mondelli et al.
7,730,953 B2 6/2010 Casciaro
7,832,472 B2 11/2010 Themig
2001/0007284 A1 7/2001 French et al.
2004/0007365 A1 1/2004 Hill et al.
2005/0061372 A1 3/2005 McGrath et al.
2005/0072572 A1 4/2005 Churchill
2005/0126638 A1 6/2005 Gilbert
2005/0205264 A1 9/2005 Starr et al.
2006/0124310 A1 6/2006 Lopez de Cardenas et al.
2006/0169463 A1 8/2006 Howlett
2006/0175092 A1 8/2006 Mashburn
2006/0213670 A1 9/2006 Bishop et al.
2006/0243455 A1 11/2006 Telfer et al.
2007/0007007 A1 1/2007 Themig et al.
2007/0012438 A1 1/2007 Hassel-Sorensen
2007/0023087 A1 2/2007 Krebs et al.
2007/0095538 A1 5/2007 Szarka et al.
2007/0272413 A1 11/2007 Rytlewski et al.
2008/0066924 A1 3/2008 Xu
2008/0093080 A1 4/2008 Palmer et al.
2008/0190620 A1 8/2008 Posevina et al.
2008/0217025 A1 9/2008 Ruddock et al.
2008/0308282 A1 12/2008 Standridge et al.
2009/0032255 A1 2/2009 Surjaatmadja et al.
2009/0044946 A1 2/2009 Schasteen et al.
2009/0044955 A1 2/2009 King et al.
2009/0056934 A1 3/2009 Xu
2009/0056952 A1 3/2009 Churchill
2009/0107680 A1 4/2009 Surjaatmadja
2009/0159289 A1 6/2009 Avant et al.
2009/0308588 A1 12/2009 Howell et al.
2010/0294514 A1 11/2010 Crow et al.
2011/0108284 A1 5/2011 Flores et al.
2011/0180274 A1 7/2011 Wang et al.

FOREIGN PATENT DOCUMENTS

WO 00/15943 3/2000

OTHER PUBLICATIONS

Office Action dated Jun. 25, 2009, in U.S. Appl. No. 11/891,714, USPTO, U.S.A.
Office Action dated Jun. 19, 2009, in U.S. Appl. No. 11/891,715, U.S. Patent and Trademark Office, U.S.A.
Response to Restriction Requirement dated Apr. 22, 2009 in U.S. Appl. No. 11/891,715, U.S. Patent and Trademark Office, U.S.A.
Office Action dated Apr. 9, 2009, in U.S. Appl. No. 11/891,715, U.S. Patent and Trademark Office, U.S.A.
Notice of Allowance & Fees Due and Notice of Allowability dated Jan. 5, 2009, in U.S. Appl. No. 11/891,713, U.S. Patent and Trademark Office, U.S.A.
Office Action dated Jul. 16, 2008 in U.S. Appl. No. 11/891,713 U.S. Patent and Trademark Office, U.S.A.
International Search Report, Feb. 11, 2009 pp. 1-3, PCT/US2008/072732, Korean Intellectual Property Office.
Notification of Transmittal of the International Search Report and the Written Opinion of the International Searching Authority, or the Declaration, Feb. 11, 2009, pp. 1-4, PCT/US2008/072732, Kroean Intellectual Property Office.
Notification of Transmittal of the International Search Report and the Written Opinion of the International Searching Authority, or the Declaration, Feb. 11, 2009, pp. 1-4, PCT/US2008/072734, Korean Intellectual Property Office.
Written Opinion of the International Searching Authority, Feb. 11, 2009, pp. 1-3, PCT/US2008/072732, Korean Intellectual Property Office.
Written Opinion of the International Searching Authority, Feb. 11, 2009, pp. 1-4, PCT/US2008/072734, Korean Intellectual Property Office.
International Search Report, Feb. 11,2 009, pp. 1-3, PCT/US2008/072734, Korean Intellectual Property Office.

International Search Report, Feb. 11, 2009, pp. 1-3, PCT/US2008/072735, Korean Intellectual Property Office.
Notification of Transmittal of the International Search Report and the Written Opinion of the International Searching Authority, or the Declaration, Feb. 11, 2009, pp. 1-4, PCT/US2008/072735, Korean Intellectual Property Office.
Notification of Transmittal of the International Search Report and the Written Opinion of the International Searching Authority, or the Declaration, Jan. 19, 2009, pp. 1-4, PCT/US2008/072470, Korean Intellectual Property Office.
Written Opinion of the International Searching Authority, Feb. 11, 2009, pp. 1-4, PCT/US2008/072735, Korean Intellectual Property Office.
Written Opinion of the International Searching Authority, Jan. 19, 2009, pp. 1-3, PCT/US2008/072470, Korean Intellectual Property Office.
International Search Report, Jan. 19, 2009, pp. 1-3, PCT/US2008/072470, Korean Intellectual Property Office.
Baker Hughes, Baker Oil Tools, Conventional Fishing Technical Unit; Pump Out Sub Product Family No. H14061, Jun. 7, 2005, 1 page.
Ross, C. M., et al., "Current Materials and Devices for Control of Fluid Loss," SPE 54323, Apr. 1999, pp. 1-16.
Hoffman, C.R., "One-Trip Sand-Control/Liner Hangar/ Big-Bore Completion System," SPE 101086, Sep. 2006, pp. 1-10.
G.L. Rytlewski, A Study of Fracture Initiation Pressures in Cemented Cased-Hole Wells Without Perforations, May 15, 2006, pp. 1-10, SPE 100572, Society of Petroleum Engineers, U.S.A.
Boscan, J., et al., "Successful Well Testing Operations in High-Pressure/High-Temperature Encironment; Case Histories," SPE 84096, Oct. 2003, pp. 1-15.
Brad Musgrove, Multi-Layer Fracturing Solution Treat and Produce Completions, Nov. 12, 2007, pp. 1-23, Schlumberger, U.S.A.
RFID Keystone Module, RFID & Intelligent Products, Petrowell retrieved online on May 27, 2009 from: http://www.petrowell.co.uk/index2.php?option=com_docman&task=doc_view&gid=15&Itemid=26.
StageFRAC Maximize Reservoir Drainage, 2007, pp. 1-2, Schlumberger, U.S.A.
TAP Completion System, Schlumberger, 4 pages, Dec. 2007.
International Search Report and Written Opinion of the International Searching Authority; PCT/US2010/044378; Mailed Mar. 17, 2011.
International Search Report; PCT/US2010/033737; Korean Intellectual Property Office; Mailed Jan. 24, 2011.
International Search Report; Date of Mailing Jan. 24, 2011; International Appln No. PCT/US2010/034736; 3 Pages.
International Search Report; Date of Mailing Jan. 24, 2011; Internatiaonal Appln. No. PCT/US2010/034752; 3 Pages.
International Search Report and Written Opinion; Date of Mailing Feb. 11, 2011; International Appln No. PCT/US2010/041049; International Search Report 5 Pages and Written Opinion 3 Pages.
Notification of Transmittal of the International Search Report and the Written Opinion of the International Searching Authority; PCT/US2010/044856; Mailed Apr. 15, 2011.
Notification of Transmittal of the International Search Report and The Written Opinion of the International Searching Authority; PCT/US2010/044383; Mailed Apr. 15, 2011.
International Search Report; PCT/US2010/044399; International Searching Authority KIPO; Mailed Mar. 21, 2011.
Notification of Transmittal of the International Search Report and The Written Opinion of the International Searching Authority; PCT/US2010/054487; International Searching Authority; KIPO; Mailed Jun. 3, 2011.
Notification of Transmittal of the International Search Report and the Written Opinion of the International Searching Authority; PCT/US2010/049810; International Searching Authority KIPO; Mailed Apr. 25, 2011.
International Search Report and Written Opinion; Date of Mailing Aug. 29, 2011; International Application No. PCT/US2011/022523; International Filing Date Jan. 26, 2011; Korean Intellectual Property Office; International Search Report 5 pages; Written Opinion 3 pages.
Notification of Transmittal of The International Search Report and the Written Opinion of the International Searching Authority; PCT/US2011/041663; Korean Intellectual Property Office; Mailed Dec. 14, 2011; 8 pages.

* cited by examiner

TUBULAR ACTUATOR, SYSTEM AND METHOD

BACKGROUND

Tubular system operators are always receptive to new methods and devices to permit actuation of tubular tools such as those in industries concerned with earth formation boreholes, such as hydrocarbon recovery and gas sequestration, for example. It is not uncommon for various operations in these industries to utilize a temporary or permanent plugging device against which to build pressure to cause an actuation.

Sometimes actuating is desirable at a first location, and subsequently at a second location. Moreover, additional actuating locations may also be desired and the actuation can be sequential for the locations or otherwise. Systems employing droppable members, such as balls, for example, are typically used for just such purpose. The ball is dropped to a ball seat positioned at the desired location within the borehole thereby creating the desired plug to facilitate the actuation.

In applications where the first location is further from surface than the second location, it is common to employ seats with sequentially smaller diameters at locations further from the surface. Dropping balls having sequentially larger diameters allows the ball seat furthest from surface to be plugged first (by a ball whose diameter is complementary to that seat), followed by the ball seat second furthest from surface (by a ball whose diameter is complementary to that seat) and so on.

The foregoing system, however, creates increasingly restrictive dimensions within the borehole that can negatively impact flow therethrough as well as limit the size of tools that can be run into the borehole. Systems and methods that allow operators to increase the number of actuatable locations within a borehole without the drawbacks mentioned would be well received in the art.

BRIEF DESCRIPTION

Disclosed herein is a tubular actuating system. The system includes, a tubular, a plurality of same plugs runnable within the tubular, an alterable actuator disposed at the tubular that is alterable in response to passage of a first of the plurality of same plugs run into contact therewith, a second of the plurality of same plugs is seatingly engagable with the alterable actuator run thereagainst when in an altered condition such that pressure built up against the second of the plurality of same plugs causes actuational movement of the alterable actuator, and a flapper seat movably disposed at the alterable actuator between at least a first position defined by the alterable actuator in an unaltered position and a second position defined by the alterable actuator in an altered position.

Further disclosed herein is a method of actuating a tubular actuator. The method includes, running a first plug within a tubular, engaging an actuator with the first plug, altering the actuator with the first plug, passing the actuator with the first plug, running a second plug that is dimensioned substantially the same as the first plug within the tubular, seatingly engaging the actuator with the second plug, pressuring up against the second plug seatingly engaged with the actuator, and moving the actuator.

Further disclosed herein is a tubular actuator. The tubular actuator includes, a body, and at least one seat movably disposed at the body configured to be moved during passage of a first engagable member thereby to be subsequently seatingly engagable with a subsequent engagable member, and the subsequent engagable member is substantially the same as the first engagable member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Embodiments of tubular actuating systems disclosed herein include actuators disposed in a tubular that are altered during passage of a first plug run thereby such that the actuators are seatingly engagable with a second plug of the same dimensions run thereagainst.

Figure 1:
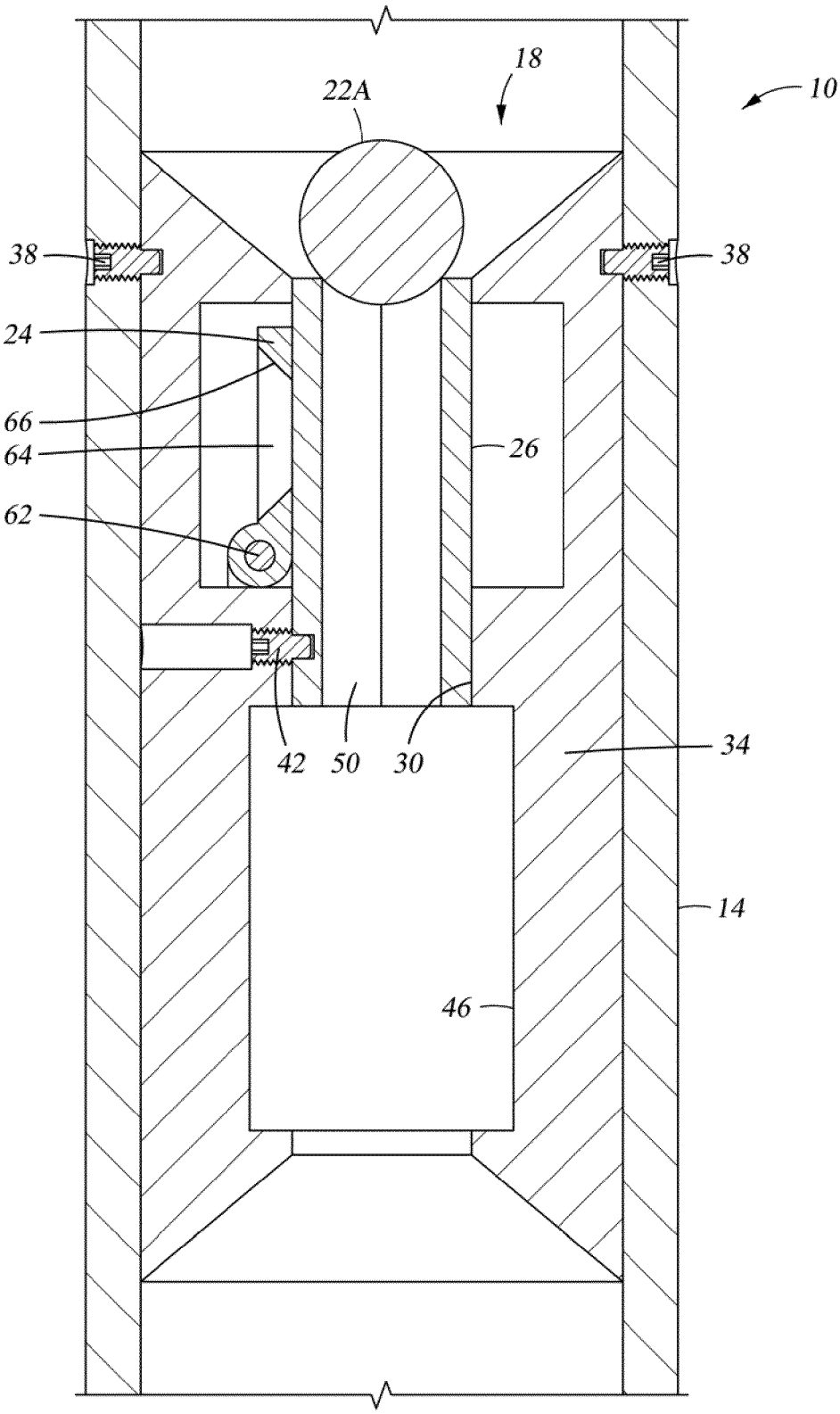
FIG. 1 depicts a cross sectional view of an tubular actuator disclosed herein engaged with a first plug.
Figure 2:
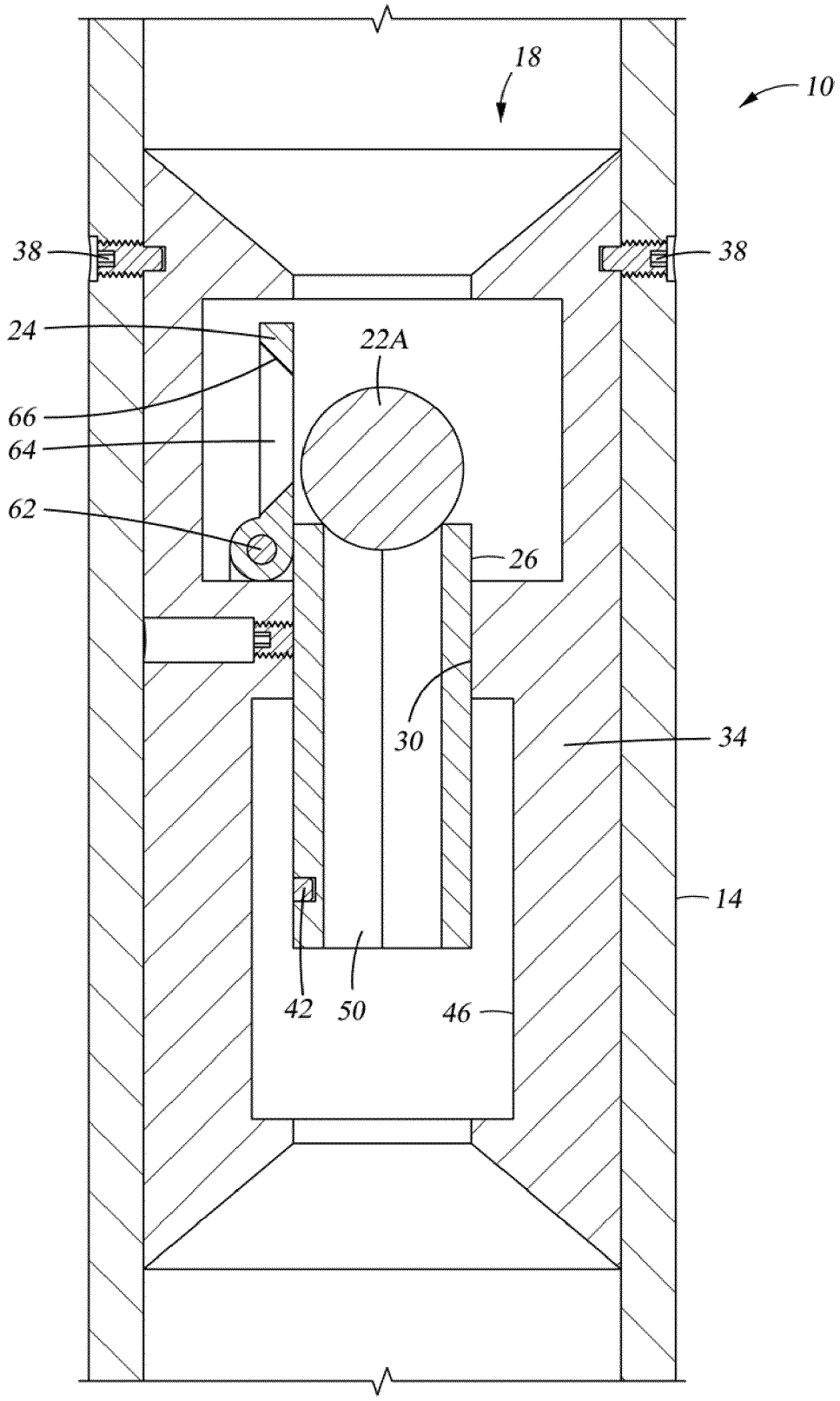
FIG. 2 depicts a cross sectional view of the tubular actuator of FIG. 1 engaged with the first plug after the first plug has moved a support member.
Figure 3:
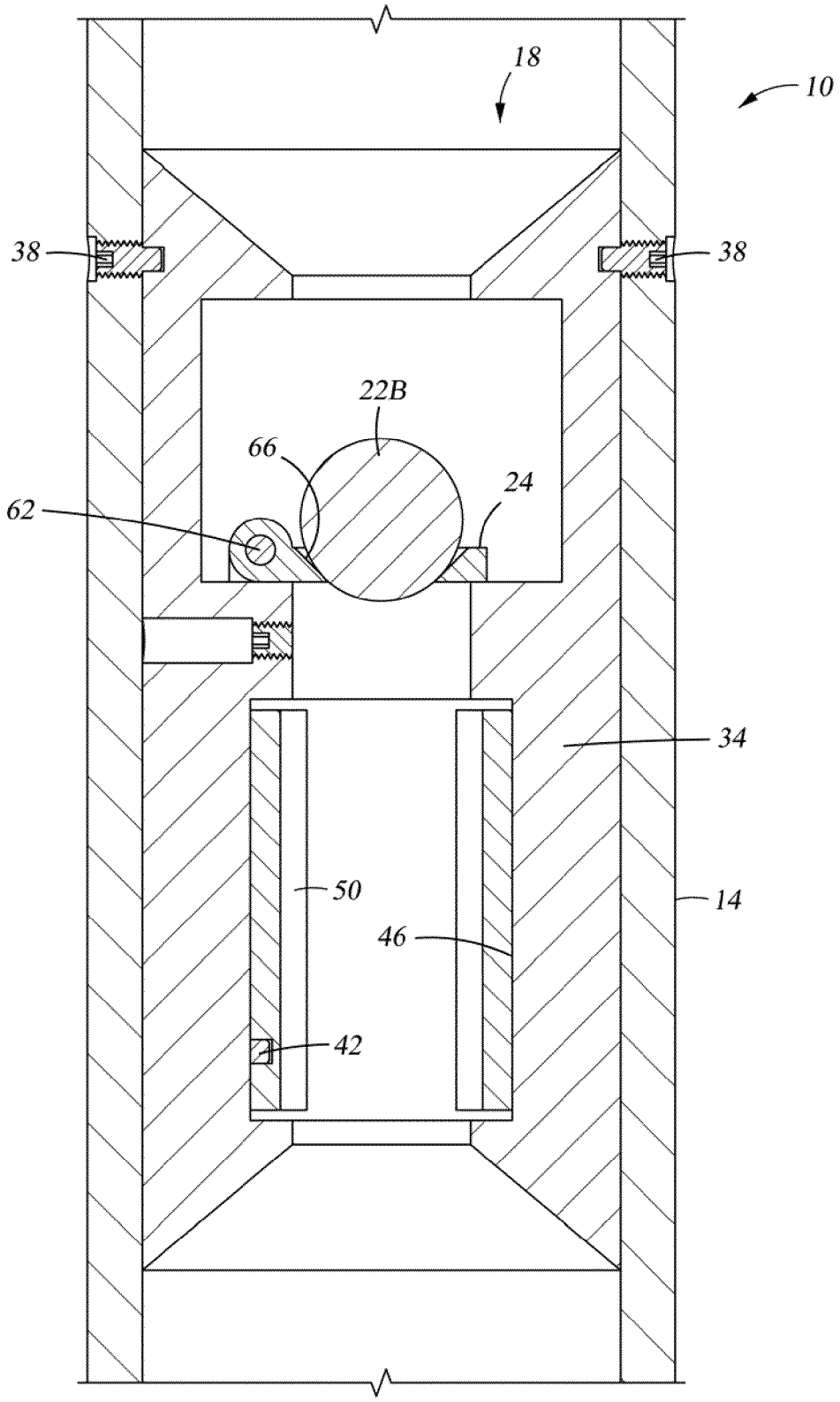
FIG. 3 depicts a cross sectional view of the tubular actuator of FIG. 1 in an altered position and engaged with a second plug after having passed the first plug.

Referring to FIGS. 1-3, an embodiment of a tubular actuating system disclosed herein is illustrated generally at 10. The actuating system 10 includes, a tubular 14 having an actuator 18 disposed therein, and a plurality of same plugs 22A-22B runnable within the tubular 14, illustrated herein as balls, and a flapper 24. The actuator 18 is configured to be altered by the first ball 22A passing thereby such that the second ball 22B (FIG. 3) run thereagainst is seatingly engaged therewith. An expandable support member 26, illustrated herein as a C-ring, is restrained perimetrically by a small inner radial surface portion 30 of a sleeve 34 that is longitudinally fixed to the tubular 14 by one or more release members 38, shown as shear screws (FIG. 1). The C-ring 26 is fixed longitudinally to the sleeve 34 by one or more release members 42, also shown herein as a shear screw. The sleeve 34 has a large inner radial surface portion 46 that permits the C-ring 26 to expand radially outwardly when the C-ring 26 is moved longitudinally beyond the small inner radial surface portion 30 (FIG. 2). The C-ring 26 is urged to move longitudinally by pressure acting upon the ball 22A that is seated against the C-ring 26. The ball 22A is allowed to pass through a bore 50 of the C-ring 26 when the C-ring 26 is in the radially expanded position (FIG. 3).

A flapper 24, is biased from a first position (FIGS. 1 and 2) wherein the flapper 24 is oriented substantially parallel a longitudinal axis of the tubular 14 toward a second position (FIG. 3) wherein the flapper 24 is oriented substantially perpendicular to the longitudinal axis of the tubular 14 by a biasing member (not shown) such as a torsion spring, for example. At least one of the C-ring 26 and the first ball 22A prevent the flapper 24 from moving to the second position until the C-ring 26 and the ball 22A have passed sufficiently by the flapper 24 to allow the flapper 24 to rotate about a pivot point 62.

Once the flapper 24 is in the second position as illustrated in FIG. 3, a port 64 in the flapper 24 serves as a seat 66 for the second ball 22B while permitting fluid flow and pressure therethrough. As such, the ball 22A may seatingly engage another seat (not shown in this embodiment) positioned further along the tubular 14 than the actuator 18, and fluid flow through the port 64 can allow for additional operations therethrough, such as, actuations, fracturing and production, for example, in the case wherein the tubular is used in a downhole wellbore for hydrocarbon recovery.

When the second ball 22B is seatingly engaged in the port 64 of the flapper 24, pressure built up against the second ball 22B, the flapper 24 and the sleeve 34 can create longitudinal forces adequate to shear the shear screws 38. After the shear screws 38 have sheared the sleeve 34 of the actuator 18 can be urged to move relative to the tubular 14 to actuate a tool (not shown). This actuation can be used to open ports (not shown) for example through the tubular 14 in a tubular valving application, for example.

Figure 4:
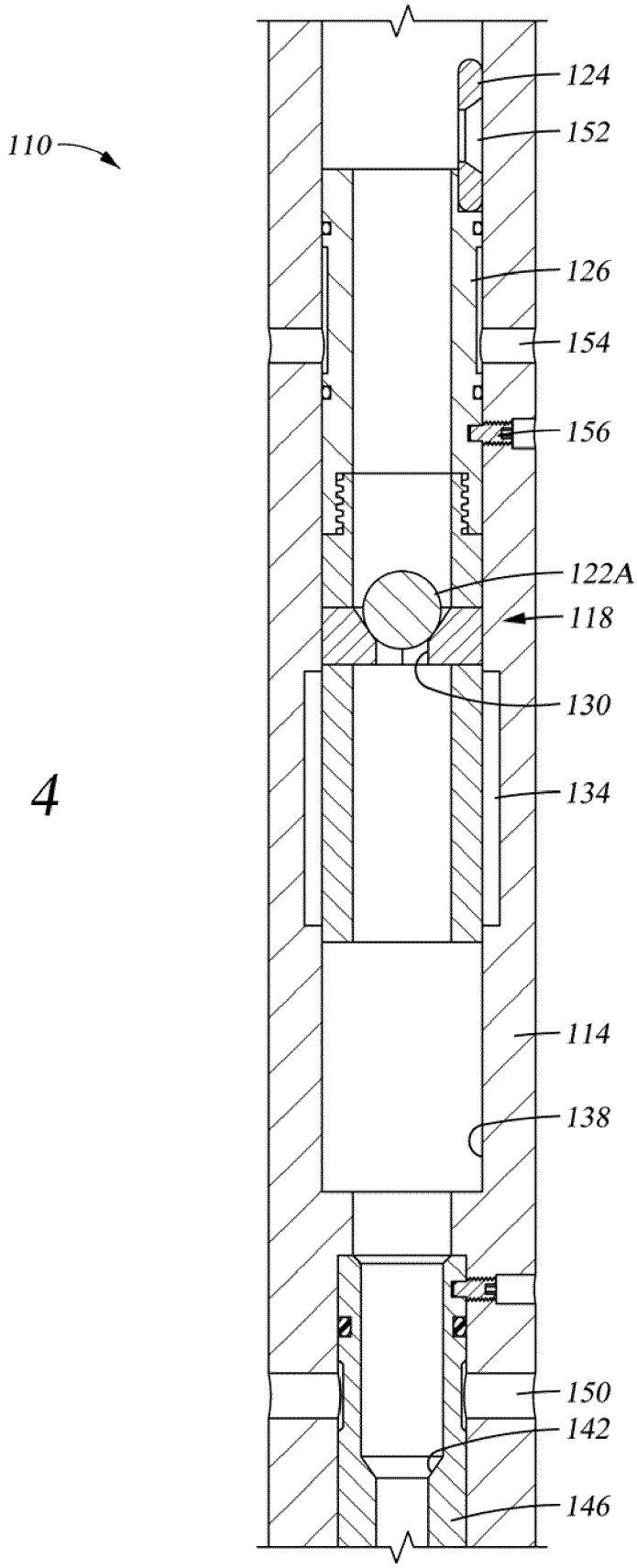
FIG. 4 depicts a partial cross sectional view of an alternate tubular actuator disclosed herein with a first plug seatingly engaged therewith.
Figure 5:
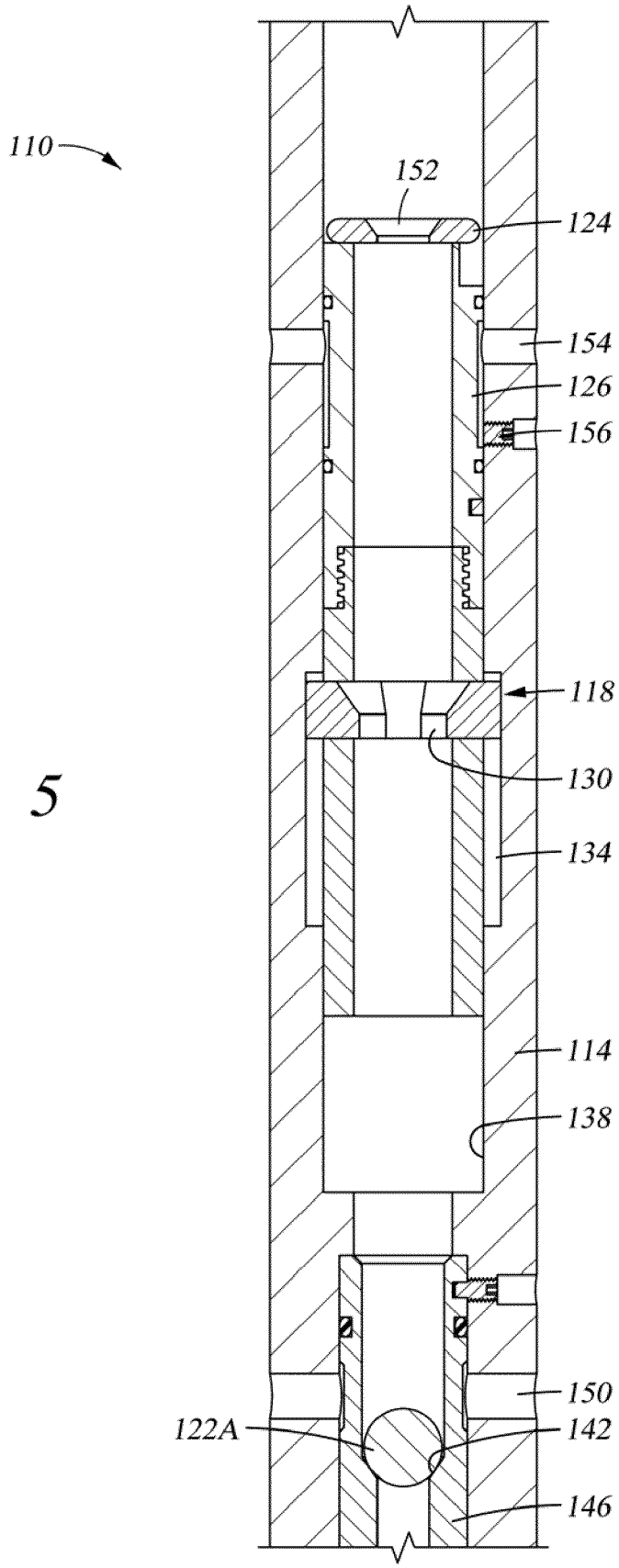
FIG. 5 depicts a partial cross sectional view of the tubular actuator of FIG. 4 in an altered position after having passed a first plug.
Figure 6:
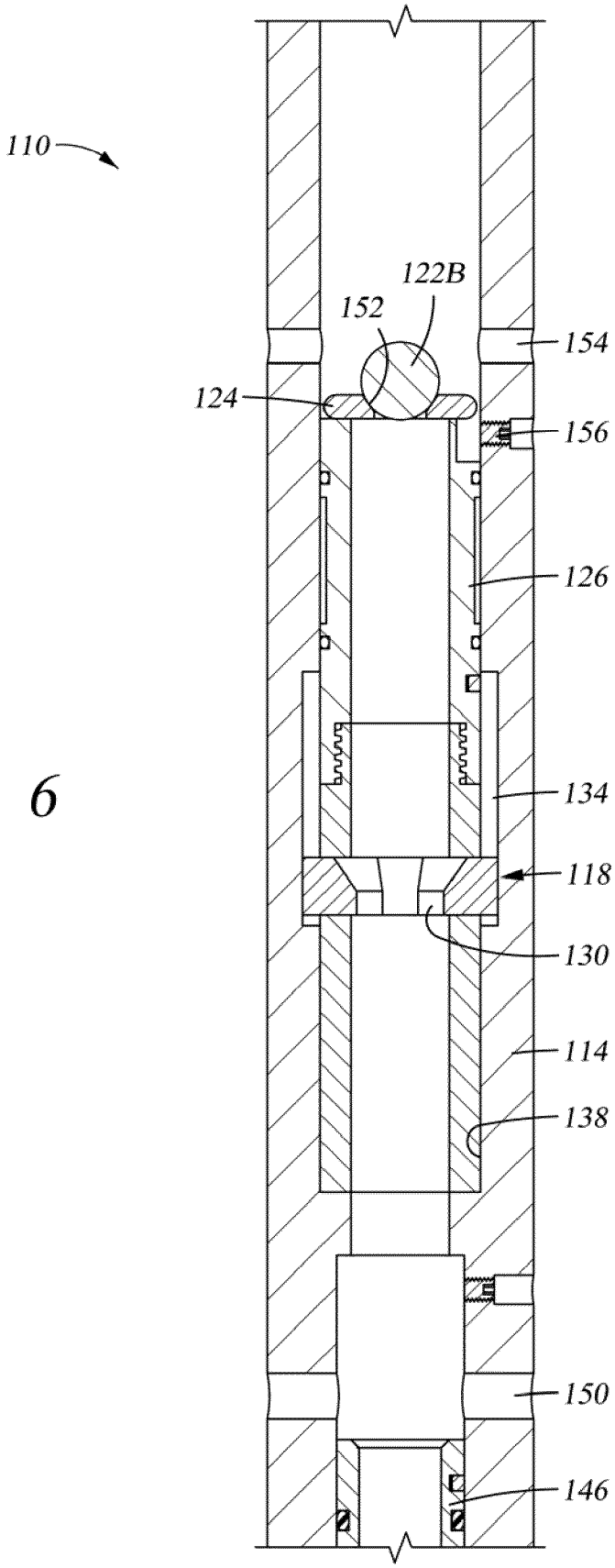
FIG. 6 depicts a partial cross sectional view of the tubular actuator of FIG. 4 engaged with a second plug.

Referring to FIGS. 4-6, an alternate embodiment of a tubular actuating system is illustrated generally at 110. The tubular actuating system 110 includes, a tubular 114, an actuator 118, a plurality of plugs 122A-122B, and a flapper 124. The actuator 118 includes a support sleeve 126 that is longitudinally movable relative to the tubular 114 between at least a first position shown in FIG. 4 and a second position shown in FIG. 5. Release member 156 holds the support sleeve 126 in the first position relative to the tubular 114. The support sleeve 126 maintains the flapper 124 in a longitudinal orientation, as shown in FIG. 4, when in the first position, and allows the flapper 124 to reorient into a radial orientation, as shown in FIG. 5, when in the second position. A restrictive portion 130 of the support sleeve 126 is seatingly engagable with the plug 122A, such that when the plug 122A is run thereagainst will at least partially seal the plug 122A to the restrictive portion 130. This at least partial seal allows pressure built thereagainst to urge the support sleeve 126 in a downstream direction, according to the direction of fluid supply pressure, which is from the first position and toward the second position.

The restrictive portion 130 is configured to allow the restrictive portion 130 to expand radially outwardly when the support sleeve 126 is in the second position. A recess 134 in an inner wall 138 of the tubular 114 that longitudinally aligns with the restrictive portion 130 can facilitate the radial expansion. The radial expansion allows the plug 122A seatingly engaged with the restrictive portion 130 to pass therethrough. After the plug 122A has passed therethrough it is free to seatingly engage with a seat 142 of an alternate actuator 146, for example, to initiate actuation thereof.

The plug 122A is free to pass the flapper 124 when the flapper 124 is in the longitudinal orientation and seatingly engagable with a port 152 in the flapper 124 when the flapper 124 is in the radial orientation. As such, the support sleeve 126 of the actuator 118 is configured to be moved from the first position to the second position by the movable engagement of the first plug 122A with the restrictive portion 130 as described above. The recess 134 provides a stop for the restrictive portion 130 to engage to limit travel of the sleeve 126 to the second position. The movement of the support sleeve 126 allows the flapper 124 to move from the longitudinal orientation to the radial orientation. A biasing member, such as a torsional spring, not shown, for example, may facilitate such movement. Once the flapper 124 is in the radial orientation it is positioned to seatingly engage the second plug 122B when it is run thereagainst. Pressure built against the second plug 122B run against the flapper 124 can urge the flapper 124 and the support sleeve 126 of the actuator 118 to move thereby creating an actuational movement from the second position to a third position, for example, as shown in FIG. 6. The restrictive portion 130 can serve as a release mechanism engaged in the recess 134 that must be released before the sleeve 126 can move to the third position.

The foregoing tubular actuating system 110 allows an operator to double the number of actuations possible with a single sized plug 122A, 122B. This is possible since the first plug 122A is able to pass the actuator 118, albeit altering the actuator 118 in the process, and functionally engage the alternate actuator 146, while the second plug 122B, that is dimensioned the same as the first plug 122A, is functionally engagable with the actuator 118.

A useful application of the tubular actuating system 110 disclosed herein is to increase the number of frac zones possible within a wellbore. By using the actuators 118 and 146 to open ports 154 and 150 in the tubular 114 respectively, the system 110 allows for both ports 150, 154 to be opened sequentially with the single sized plugs 122A, 122B.

Figure 7:
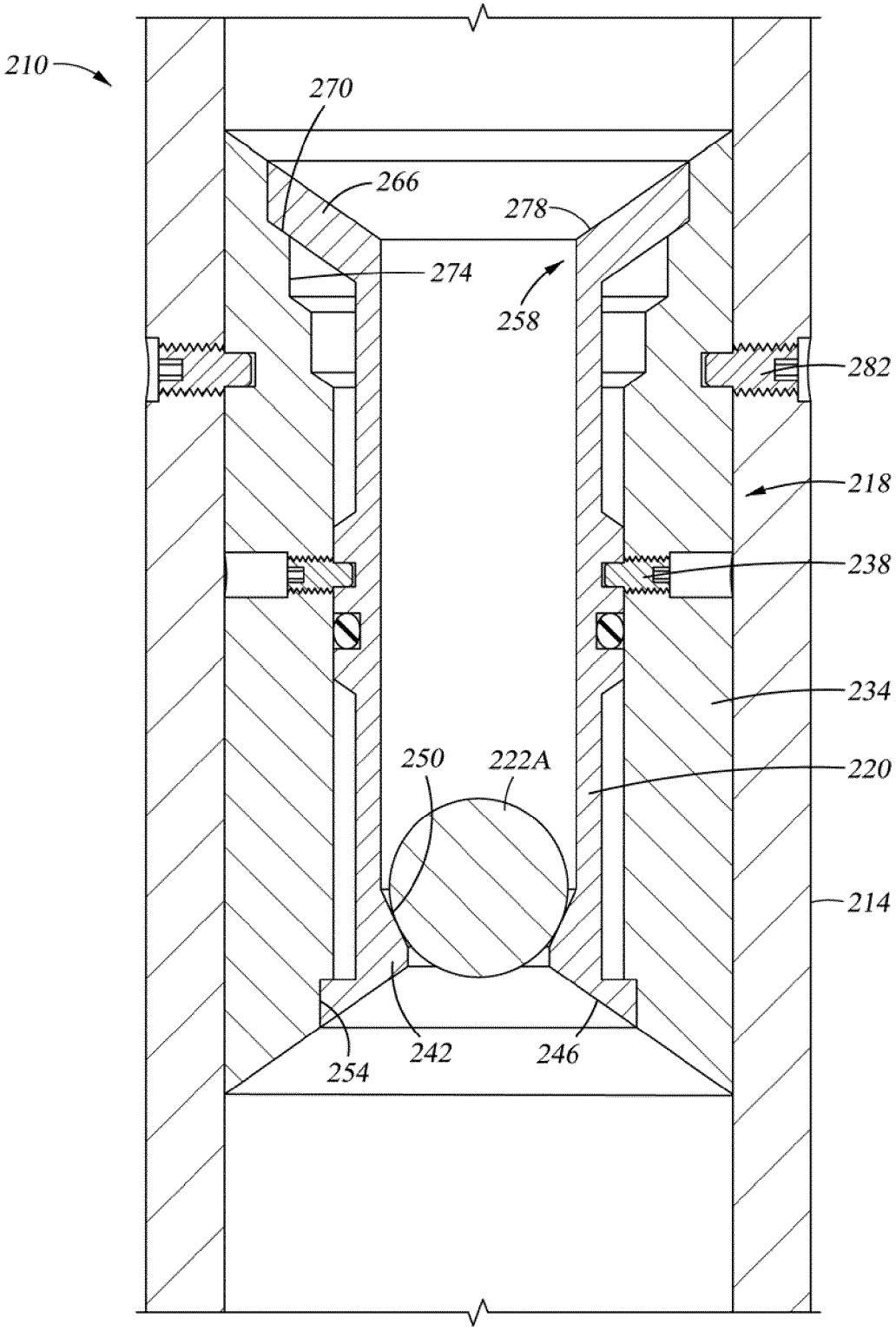
FIG. 7 depicts a partial cross sectional view of another alternate embodiment of a tubular actuator disclosed herein engaged with a first plug.
Figure 8:
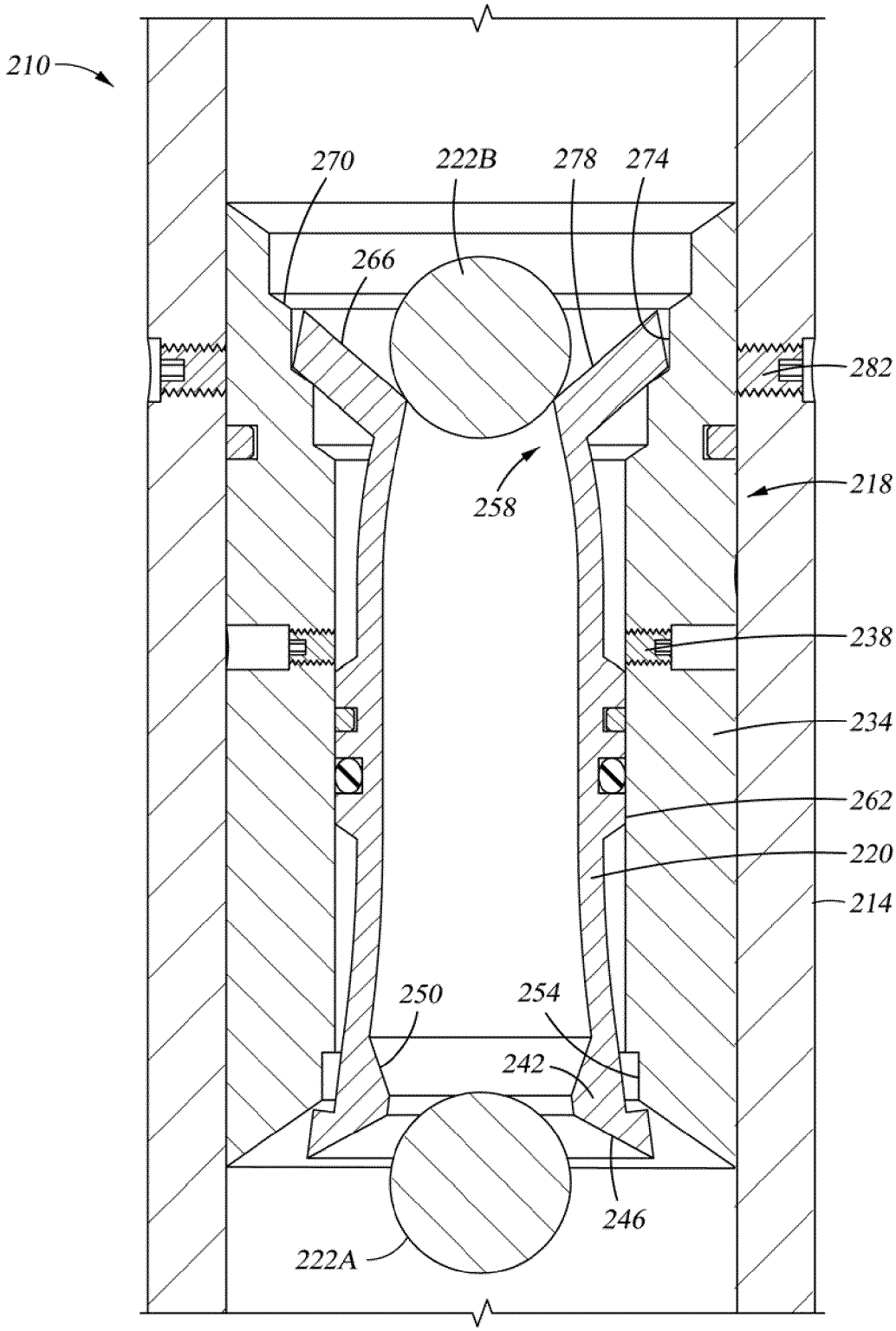
FIG. 8 depicts a partial cross sectional view of the tubular actuator of FIG. 7 in an altered position and engaged with a second plug.
Figure 9:
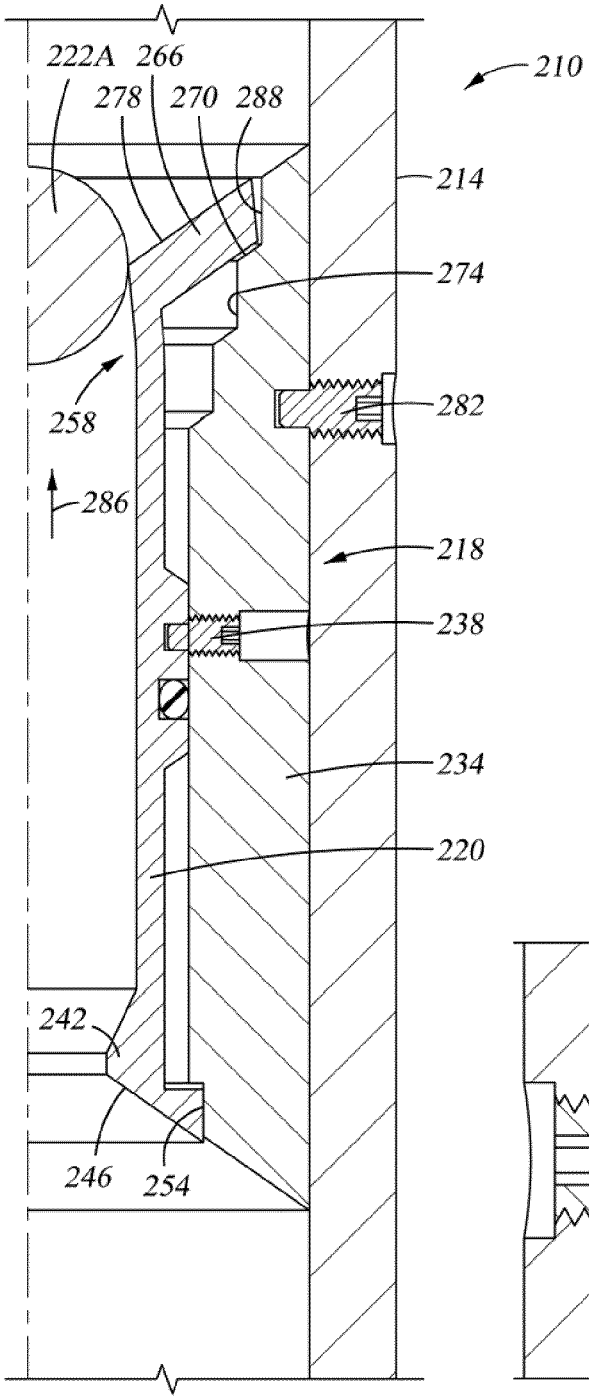
FIG. 9 depicts a partial cross sectional view of the tubular actuator of FIG. 7 after being partially reset by the first plug.

Referring to FIGS. 7-9, an alternate embodiment of a tubular actuating system is illustrated generally at 210. The actuating system 210 includes, a tubular 214, an actuator 218 having one or more slides 220, with a plurality of the slides 220 being incorporated in this embodiment, and a plurality of plugs 222 having a same size and being depicted herein as balls. The slides 220 of the actuator 218 are longitudinally movably relative to a sleeve 234 after release of one or more releasable members 238, shown herein as shear screws that fix the slides 220 to the sleeve 234. The slides 220 and the sleeve 234 are initially in a first position relative to one another, as shown in FIG. 7, such that protrusions 242 on first ends 246 thereof form a defeatable seat 250, seatingly receptive to the plugs 222. Pressure, built to at least a threshold pressure, against the first plug 222A seatably engaged with the defeatable seat 250, can cause release of the shear screws 238 resulting in relative movement between the slides 220 and the sleeve 234, thereby allowing the slides 220 to move to a second position as illustrated in FIG. 8. A support surface 254 on the sleeve 234 prevents radial expansion of the defeatable seat 250 until the first ends 246 have moved longitudinally beyond the support surface 254.

After the first ends 246 have moved beyond the support surface 254 they can be urged radially outwardly by the first plug 222A passing therethrough, thereby defeating the defeatable seat 250. The first plug 222A, after having passed through the actuator 218, can then be utilized downstream against another actuator seat (not shown) for example. The movement of the slides 220 relative to the sleeve 234 causes second ends 258 to collapse radially inwardly in response to at least one of pivoting action of the slides 220 about a fulcrum 262 in slidable contact with the sleeve 234, and ramping of a radial extension 266 of the slides 220 along a ramped surface 270 on the sleeve 234. Once the slides 220 are moved relative to the sleeve 234 the radial extensions 266 are supported from radial expansion by the support surface 274 thereby maintaining a seat 278 seatingly receptive of the second plug 222B run against the actuator 218. It should be noted that the slides 220 might also be made to flex in the fashion of a collet thereby allowing the second ends 258 to collapse radially inwardly during the formation of the seat 278.

Pressure can be built against the second plug 222B seated against the seat 278 until release members 282, illustrated herein as shear screws, that longitudinally fix the sleeve 234 to the tubular 214, release. Such release allows the sleeve 234 to move to a downstream position relative to the tubular 214 in an actuation motion as depicted in FIG. 8.

The slides 220 can be reset to the first position relative to the sleeve 234, as shown in FIG. 9. This resetting can be achieved by pumping or flowing the first plug 222A in a direction of arrow 286 that is opposite to the direction in which it caused the slides 220 to move from the first position to the second position. The first plug 222A contacts the second ends 258 of the slides 220 and causes the radial extensions 266 to travel along the support surface 274, down the ramped surface 270 onto a support surface 288. When the radial extensions 266 are supported by the support surface 288 the seat 278 has been radially expanded to a dimension wherein the first plug 222A is passable thereby. The sleeve 234 could also be resettable to its original position relative to the tubular 214, thereby resetting the actuator to its starting position.

Figure 10:
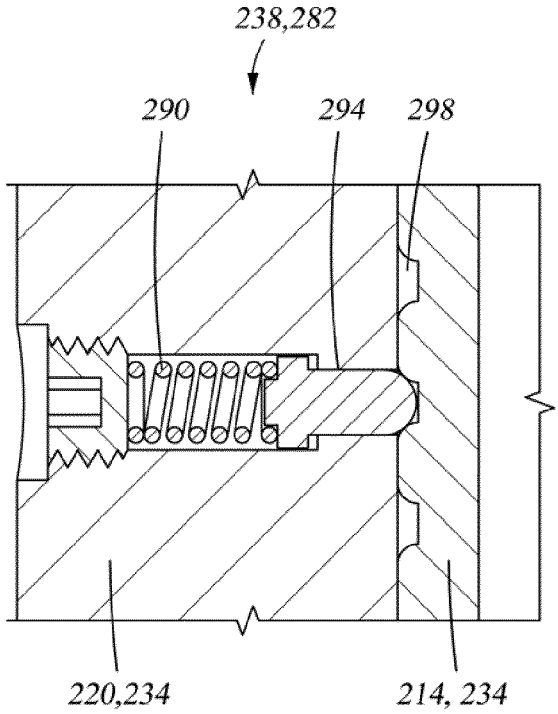
FIG. 10 depicts an alternate embodiment of releasable members disclosed herein.

Referring to FIG. 10, alternate embodiments of the release members 238 and 282 that are non-failing devices are illustrated. A biasing member 290, shown herein as a compression spring, biasingly engages a dog 294 into one or more notches 298 in either the tubular 214 or the sleeve 234 to longitudinally releasable lock the sleeve 234 or the slides 220 to their respective mating component. Use of these non-failing releasable members 238, 282, could allow the actuator 218 to be completely resettable.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A tubular actuating system, comprising:

a tubular;

a plurality of same plugs runnable within the tubular and being dimensioned substantially the same; and an alterable actuator including a flapper seat being alterable in response to passage of a first of the plurality of same plugs run into contact therewith, a second of the plurality of same plugs being seatingly engagable with the alterable actuator run thereagainst when in an altered condition such that pressure built up against the second of the plurality of same plugs causes actuational movement of the alterable actuator, the flapper seat being movably disposed between at least a first position defined by the alterable actuator being in an unaltered position and not seatably engagable with one of the plurality of same plugs and a second position defined by the alterable actuator being in an altered position and being seatably engagable with one of the plurality of same plugs.

2. The tubular actuating system of claim 1, further comprising a second actuator seatingly engagable with the first of the plurality of same plugs such that pressure built up against the first of the plurality of same plugs causes actuational movement of the second actuator.

3. The tubular actuating system of claim 1, wherein the plurality of same plugs are balls.

4. The tubular actuating system of claim 1, further comprising a support member movable relative to the flapper seat that prevents movement of the flapper seat until the support member has been moved.

5. The tubular actuating system of claim 4, wherein the support member is tubular.

6. The tubular actuating system of claim 4, wherein the support member is radially expandable to allow passage of at least one of the plurality of same plugs.

7. The tubular actuating system of claim 4, further comprising at least one release member in operable communication with the support member and the alterable actuator.

8. The tubular actuating system of claim 7, wherein the at least one release member is a shear screw.

9. The tubular actuating system of claim 1, further comprising at least one release member in operable communication with the alterable actuator and the tubular.

10. The tubular actuating system of claim 9, wherein the at least one release member is a shear screw.

11. The tubular actuating system of claim 1, further comprising a biasing member in operable communication with the flapper seat biasing the flapper seat toward the second position.

12. A method of actuating a tubular actuator, comprising:

running a first plug within a tubular;

engaging an actuator with the first plug;

altering the actuator with the first plug;

moving a flapper seat from a first position to a second position, the first position being nonseatable with a plug dimensioned substantially the same as the first plug and the second position being seatable with a plug dimensioned substantially the same as the first plug;

passing the first plug by the actuator;

running a second plug that is dimensioned substantially the same as the first plug within the tubular;

seatingly engaging the flapper seat with the second plug after the first plug has passed the actuator;

pressuring up against the second plug seatingly engaged with the flapper seat; and moving the actuator.

13. The method of actuating a tubular actuator of claim 12, wherein the running the first plug includes at least one of dropping and pumping the first plug.

14. The method of actuating a tubular actuator of claim 12, wherein the moving the flapper seat includes pivotally rotating a flapper seat.

15. The method of actuating a tubular actuator of claim 12, wherein actuating the actuator includes longitudinally moving an altered actuator.

16. A tubular actuator, comprising:

a body; and at least one flapper seat movably disposed at the body configured to be moved and altered in response to passage of a first engagable member thereby from a position not seatable with the first engagable member to a position seatingly engagable with a subsequent engagable member, the subsequent engagable member being dimensioned substantially the same as the first engagable member, the tubular actuator being actuatable in response to movement of the body in response to pressure built against the subsequent engagable member when engaged with the at least one flapper seat.

* * * * *